US009528271B2

(12) United States Patent
Rook et al.

(10) Patent No.: US 9,528,271 B2
(45) Date of Patent: Dec. 27, 2016

(54) ROOFTOP SUPPORT BASE

(71) Applicant: PHD Manufacturing, Inc., Columbiana, OH (US)

(72) Inventors: Benjamin J Rook, Canfield, OH (US); Robert J Burnside, Struthers, OH (US)

(73) Assignee: PHD Manufacturing, Inc., Columbiana, OH (US)

( * ) Notice: Subject to any disclaimer, the term of this patent is extended or adjusted under 35 U.S.C. 154(b) by 0 days.

(21) Appl. No.: 14/694,246

(22) Filed: Apr. 23, 2015

(65) Prior Publication Data

US 2016/0312472 A1 Oct. 27, 2016

(51) Int. Cl.
*E04H 12/12* (2006.01)
*E04D 13/00* (2006.01)

(52) U.S. Cl.
CPC ..... *E04D 13/00* (2013.01); *E04H 12/12* (2013.01)

(58) Field of Classification Search
USPC ..... 52/292, 293.2, 294, 298; 248/346.01, 248/346.4, 346.03
See application file for complete search history.

(56) References Cited

U.S. PATENT DOCUMENTS

| | | | | |
|---|---|---|---|---|
| 5,102,073 | A * | 4/1992 | Lestenkof, Jr. | F16L 3/227 138/106 |
| D367,329 | S | 2/1996 | Nelson et al. | |
| 6,364,256 | B1 * | 4/2002 | Neider | F16L 3/18 248/55 |
| 6,502,791 | B2 * | 1/2003 | Parker | F16L 3/18 248/405 |
| 6,592,093 | B2 * | 7/2003 | Valentz | F16L 3/00 248/346.01 |
| 6,679,461 | B1 | 1/2004 | Hawkins | |
| D521,851 | S | 5/2006 | Smart | |
| 7,607,619 | B2 | 10/2009 | Smart et al. | |
| 7,661,240 | B2 * | 2/2010 | Sargent | F16L 3/137 248/146 |
| 7,731,131 | B2 * | 6/2010 | Trueb | E04D 13/00 248/49 |
| D625,677 | S | 10/2010 | Robbins, Sr. et al. | |
| 8,312,692 | B2 | 11/2012 | Krovats | |
| 8,356,778 | B2 | 1/2013 | Birli et al. | |
| 2007/0045482 | A1 | 3/2007 | Smart | |

* cited by examiner

*Primary Examiner* — Alfred J Wujciak
(74) *Attorney, Agent, or Firm* — Botkin & Hall, LLP

(57) ABSTRACT

A rooftop support block is provided having tapered outside surfaces that terminate at a top surface. The top surface will carry another item that will be secured to the support block. The bottom of the block has a larger surface than the top to provide stability. The block further contains a hole that will allow a bolt or other fastener to secure the item to the support block.

10 Claims, 5 Drawing Sheets

FIG. 1
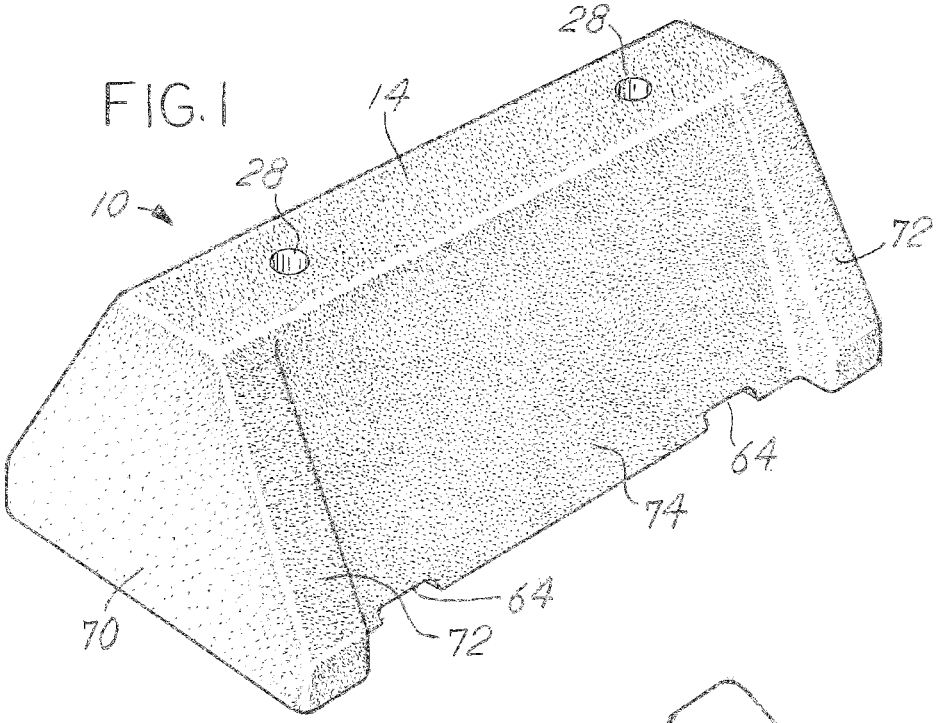
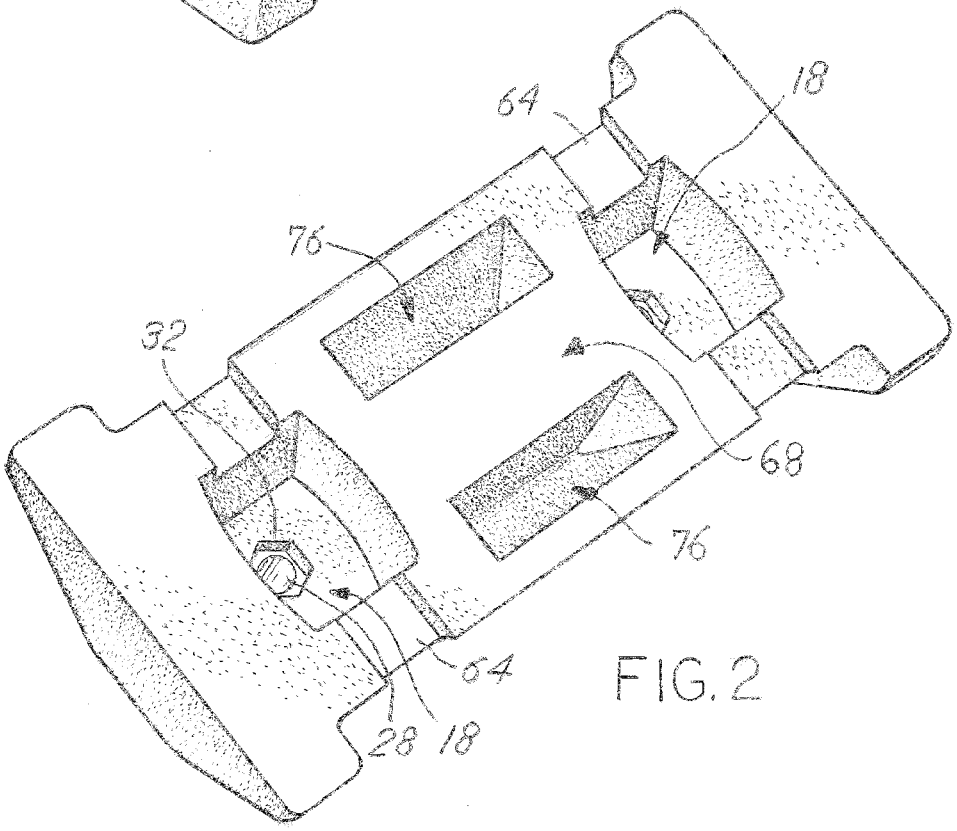
FIG. 2

ROOFTOP SUPPORT BASE

BACKGROUND OF THE INVENTION

This present disclosure relates to devices used to support pipes or other apparatus on a flat or gradually sloping rooftop. Many buildings, especially in urban areas, are constructed with a flat or shallow pitch roof. Frequently, HVAC or other utility structures are placed on the roof for convenience, ease of service, or other practical reasons. These structures frequently need air, water, cooling, Freon, or gas lines. These lines cannot be placed directly on the roof; they must be supported by a rooftop support base or other device that raises the line off of the roof surface and supports it sufficiently. Other rooftop support bases attempt to solve this problem, but they fall short for several reasons. Wood blocks are used, but these are subject to destruction by insects or decay from moisture. Other devices can be heavy or difficult to use when attaching lines to them. An improved rooftop support block is needed.

SUMMARY OF THE INVENTION

The present disclosure describes a resilient rooftop support block with a wide bottom and a relatively narrow top that can carry pipes and other devices commonly found on a rooftop. The bottom has cavities that reduce weight and others that can secure a fastener and prevent it from rotating without the user having to hold it. The block also has a center section that is relatively thick and can allow a self-tapping fastener to be driven in for securing.

BRIEF DESCRIPTION OF THE DRAWINGS

A preferred embodiment of this invention has been chosen wherein:

FIG. 1 is a top isometric view of the device;

FIG. 2 is a bottom isometric view of the device;

DESCRIPTION OF THE PREFERRED EMBODIMENT

Figure 3:
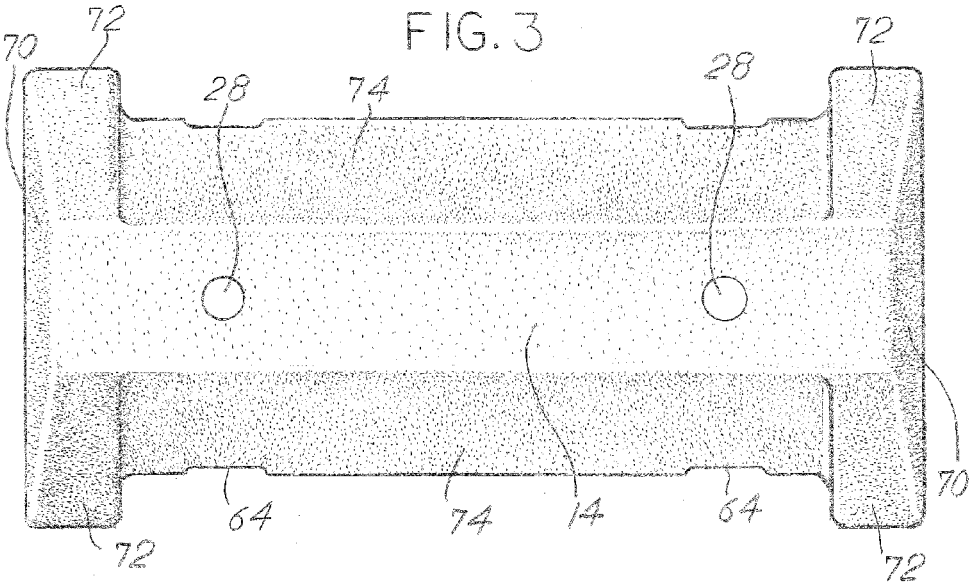
FIG. 3 is a top view of the device.

A rooftop block 10 as shown in FIG. 1 is formed from a single piece of dimensionally stable material. It has a lower surface 12 that is flat and is made to rest on a roof or other mostly horizontal surface. It is contemplated that the lower surface 12 has a texture or pattern to improve gripping or traction when resting on a sloped or irregular roof. The block 10 relies on gravity and the weight of any devices attached to it to stay in position. A flat top surface 14 is parallel to the lower surface 12 to define an overall height 16. The flat surface 14 is mostly rectangular as shown but other shapes are possible.

Turning now to the lower surface 12, a fastener cavity 18 has sidewall surfaces 22, 24 that intersect the lower surface 12 at an opening 20. The sidewall surfaces 22, 24 are tapered such that the surfaces are farther apart nearest the opening

Figure 4:
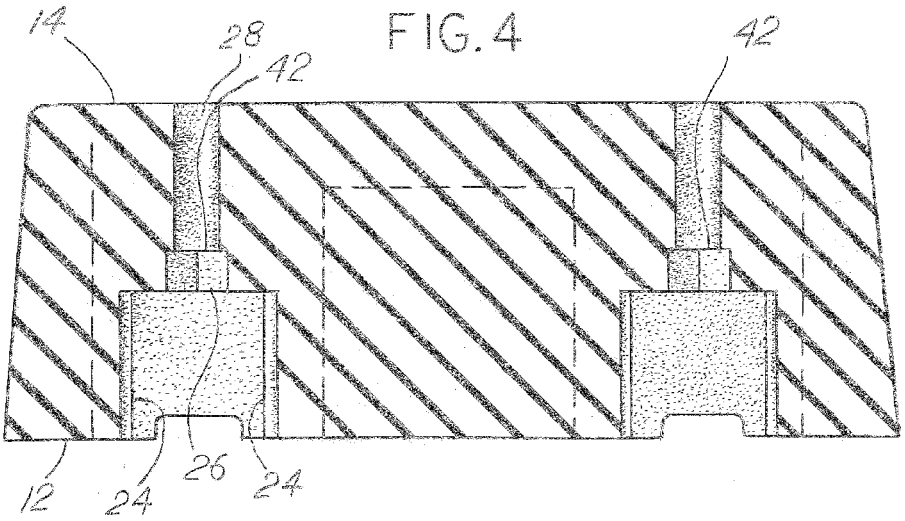
FIG. 4 is a side section view of the device.
Figure 5:
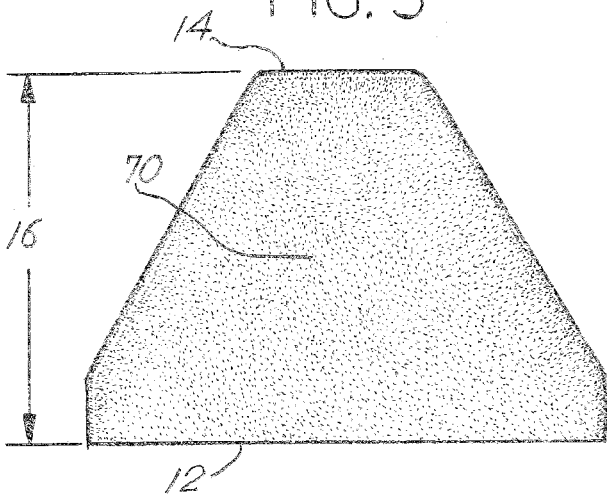
FIG. 5 is an end view of the device.
Figure 6:
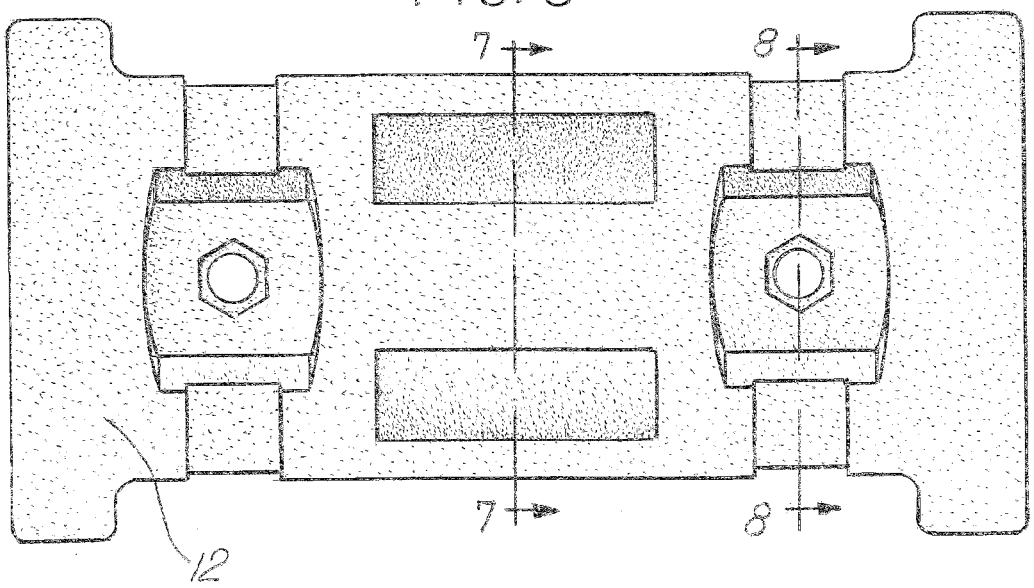
FIG. 6 is a bottom view of the device.
Figure 8:
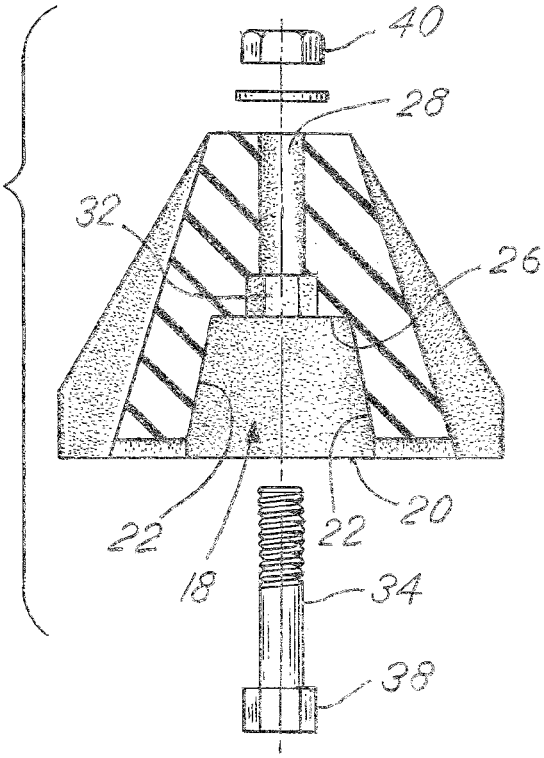
FIG. 8 is a section view 8 in FIG. 6.

20. The sidewall surfaces 22, 24 extend toward the top surface 14 and terminate into a fastener surface 26. As shown in FIGS. 4 and 8, the fastener surface 26 is near a midpoint between the lower surface 12 and top surface 14. The fastener cavities 18 are shown near the ends but they can be located at any point along the length of the block 10.

An aperture 28 is between the top surface 14 and the fastener surface 26. The aperture 28 is sized to accept a fastener shown in FIG. 8, such as threaded rod, a bolt 34, lag screw, or other fastening device. The fastener cavity 18 further includes a fastener recess 32 that can receive and retain the head 38 of a bolt 34 or a nut 40. The fastener cavity 18 has a second fastener surface 42 where the head 38 or nut 40 can compress against when the fastener is tightened. The second fastener surface 42 prevents the fastener from pulling through the aperture 28. As shown, the fastener recess 32 is a hex shape. The fastener recess 32, aperture 28, or both can be sized to be an interference fit to portions of the fastener. The interference fit allows the user to drive in part of the fastener from the fastener cavity 18 and place the block 10 on the roof without the fastener falling back out. The fastener recess 32 prevents the fastener from rotating while the other part of the fastener is tightened. The fastener recess 32 can be sized to accept commonly used fasteners.

Figure 9:
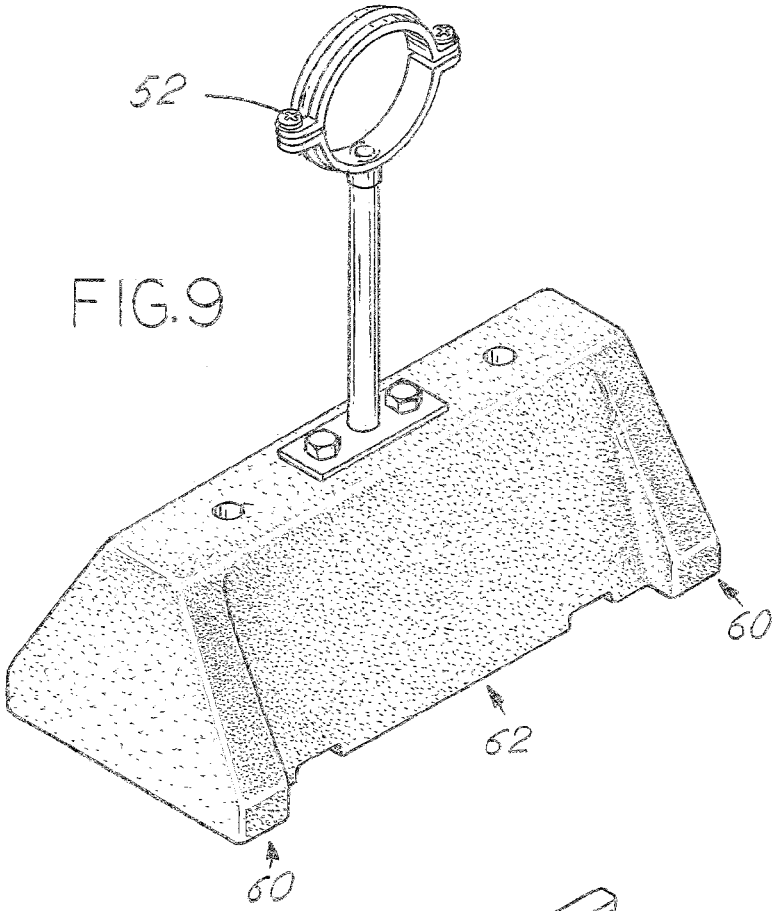
FIG. 9 is a top isometric view of the device being used with a pipe attachment bracket.
Figure 10:
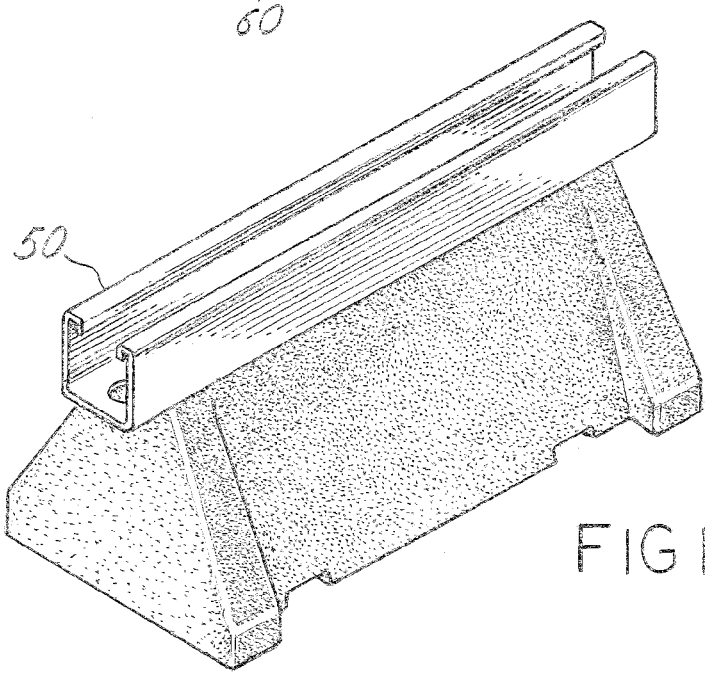
FIG. 10 is a top isometric view of the device being used with a channel.

The top surface 14 can receive a variety of external components as is shown in FIGS. 9 and 10. These external components can include strut channel 50, split rings 52, rollers, bridges, or other components that similarly function. The external components are used to attach HVAC, plumbing, or other utility lines to a device raising the line off the roof.

As shown in FIG. 9, opposite ends of the block 10 are stabilizing portions 60 where the bottom surface is larger. This provides additional stability and reduces the chances of the block 10 to rock or slide on the rooftop. Located between the stabilizing portions 60 is a center section 62. The center section 62 is narrower to allow the block 10 to be lighter and more transportable.

Located in the center section 62 are two notches 64, visible in FIG. 2. Because rainwater or other runoff can become trapped against the center section 62, the notches 64 provide a path for the runoff to pass underneath the block without becoming trapped and stagnant. As shown in FIGS. 2 and 4, the notches 64 are in-line with the fastener cavities 18 but they can be located anywhere on the bottom surface 12 where water can become trapped.

Figure 7:
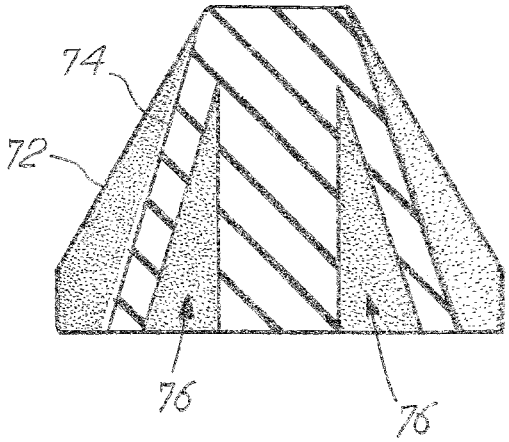
FIG. 7 is section view 7 in FIG. 6.

As shown in FIGS. 1, 3, and 7, the outside surfaces between the lower surface 12 and the top surface 14 are tapered. The end surfaces 70 intersect the lower surface 12 and the top surface 14 on the terminal ends. Side surfaces 72 on the stabilizing portions intersect the end surfaces 70 and are also tapered toward the top surface 14. The center section 62 also has tapered outside surfaces 74 that intersect the top surface 14.

Further located in the center section 62 are some coring cavities 76 that extend upwardly toward the top surface 14 with openings through the bottom surface 12. The coring cavities 76 serve to provide a more uniform wall thickness in the center section 62 and reduce weight and material consumption of the block 10. This improved consistent wall thickness is visible in section view FIG. 7. A consistent wall thickness also improves dimensional stability. Located between coring cavities 76 and apertures 28 is a thick section 68. It is contemplated that a self-tapping threaded fastener can be driven into the thick section 68 to secure another object, bracket, or apparatus. As shown in FIG. 9, the split ring 52 is attached to the block using self-tapping screws.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A rooftop support block adapted for supporting and affixing to a device and resting on a substantially horizontal surface, said support block comprising:

a monolithic elongate block having a substantially planar lower surface having an opening forming an open mouth to a fastener cavity, said fastener cavity having sidewall surfaces extending upward from said lower surface and terminating in a fastener surface circumscribed by said sidewall surfaces, said fastener surface being substantially parallel to said lower surface;

said block having a stabilizing portion at each end of said block and a center section located therebetween, said stabilizing portion being wider at said lower surface than said center section;

said block having tapered outside surfaces extending upwardly from said lower surface at an acute angle to intersect a substantially planar top surface adapted to receive said device, said top surface being substantially parallel to said lower surface, opposing tapered outside surfaces being separated at a greater distance near said lower surface than said top surface;

a fastener aperture extending through said block between said top surface and said fastener surface, said aperture being substantially perpendicular to said top surface and adapted to receive a fastener, said fastener cavity adapted to receive a portion of said fastener and fix said fastener from rotation with respect to said support block; and said lower surface interrupted by a notch extending towards said top surface, said notch intersecting said open mouth to said fastener cavity.

2. The support block of claim 1, said fastener cavity having a receiver being a recess in said fastener surface extending towards said top surface and having a second fastener surface between said fastener surface and said top surface, said recess being circumscribed by sidewall surfaces extending between said fastener surface and said second fastener surface.

3. The support block of claim 2, said sidewalls form a hex shaped cross section adapted to receive a hex shaped fastener.

4. The support block of claim 3, said fastener cavity having a portion being an interference fit adapted to retain said fastener axially.

5. The support block of claim 1, said support block formed from a resilient material.

6. The support block of claim 5, said block having a cored area, said cored area having a cored opening defined by an open mouth to a cored cavity, said cored cavity separate from said fastener cavity.

7. The support block of claim 6, said support block having at least two fastener cavities, said cored area located between said fastener cavities.

8. A rooftop support block adapted for supporting and affixing to a device and resting on a substantially horizontal surface, said support block comprising:

an elongate block having a substantially planar lower surface having an opening forming an open mouth to two fastener cavities located at distal ends of said block, said fastener cavities having sidewall surfaces extending upward from said lower surface and terminating in a fastener surface circumscribed by said sidewall surfaces, said fastener surface being substantially parallel to said lower surface, said lower surface interrupted by a notch extending towards said top surface, said notch intersecting said open mouth;

said block having a cored area, said cored area having a cored opening defined by an open mouth to a cored cavity, said cored cavity separate from said fastener cavity;

said block having a stabilizing portion at each end of said block and a center section located therebetween, said stabilizing portion being wider at said lower surface than said center section;

said block having tapered outside surfaces extending upwardly from said lower surface at an oblique angle to intersect a substantially planar top surface, said top surface being substantially parallel to said lower surface, opposing tapered outside surfaces being separated at a greater distance near said lower surface than said top surface;

a fastener aperture extending through said block between said top surface and said fastener surface, said aperture being substantially perpendicular to said top surface and adapted to receive a fastener, said fastener cavity adapted to receive said fastener and fix said fastener from rotation with respect to said support block; and a receiver being a recess in said fastener surface extending towards said top surface and having a second fastener surface between said fastener surface and said top surface, said recess being circumscribed by sidewall surfaces extending between said fastener surface and said second fastener surface, said sidewalls form a hex shaped cross section adapted to receive a hex shaped fastener.

9. The support block of claim 8, said fastener cavity having a portion being an interference fit adapted to retain said fastener axially.

10. The support block of claim 8, said support block formed from a resilient material.

* * * * *